US010443187B2

(12) United States Patent
Kumar et al.

(10) Patent No.: US 10,443,187 B2
(45) Date of Patent: Oct. 15, 2019

(54) APPARATUS FOR CLEANING A FABRIC AND A METHOD THEREOF

(71) Applicant: Wipro Limited, Bangalore (IN)

(72) Inventors: Vijay Kumar, Bangalore (IN); Thomas Chittakattu Ninan, Kerala (IN)

(73) Assignee: Wipro Limited, Bangalore (IN)

( * ) Notice: Subject to any disclaimer, the term of this patent is extended or adjusted under 35 U.S.C. 154(b) by 105 days.

(21) Appl. No.: 15/269,491

(22) Filed: Sep. 19, 2016

(65) Prior Publication Data

US 2018/0030646 A1 Feb. 1, 2018

(30) Foreign Application Priority Data

Aug. 1, 2016 (IN) ..... 201641026289

(51) Int. Cl.
*D06F 87/00* (2006.01)
*D06F 43/00* (2006.01)
*D06F 75/00* (2006.01)

(52) U.S. Cl.
CPC ..... *D06F 87/00* (2013.01); *D06F 43/002* (2013.01); *D06F 75/00* (2013.01)

(58) Field of Classification Search
CPC ..... A47L 11/40; A47L 11/4011; D06F 3/00; D06F 5/00; D06F 43/002; D06F 73/00; D06F 75/00; D06F 75/22; D06F 79/00
See application file for complete search history.

(56) References Cited

U.S. PATENT DOCUMENTS

2005/0278986 A1* 12/2005 Almanzar ..... D06F 75/14 38/77.1
2006/0179599 A1* 8/2006 Miner ..... A47L 11/34 15/320
2015/0142169 A1* 5/2015 Kim ..... A47L 11/282 700/245

* cited by examiner

*Primary Examiner* — David G Cormier
(74) *Attorney, Agent, or Firm* — Pepper Hamilton LLP

(57) ABSTRACT

The present disclosure relates to an apparatus for cleaning of fabric. Image capturing units in the apparatus captures images of the fabric. A control unit in the apparatus identifies region of stain in the fabric based on the images and activates an ejecting unit for cleaning the fabric. The ejecting unit applies a selected cleaning agent on the region of stain. A motorized wiper and a sucking mechanism are operated on the region of stain to remove stain from the fabric. In an embodiment, the apparatus may also be used for ironing the fabric. However, the fabric is ironed within an optimal temperature range suitable for the type of fabric being ironed, thereby preventing over-heating and/or burning of the fabric. Thus, the apparatus disclosed herein facilitates both cleaning and ironing of the fabric.

10 Claims, 5 Drawing Sheets

APPARATUS FOR CLEANING A FABRIC AND A METHOD THEREOF

This application claims the benefit of Indian Application Serial No. 201641026289 filed Aug. 1, 2016, which is hereby incorporated by reference in its entirety.

FIELD

The present subject matter is related, in general to fabric management, and more particularly, but not exclusively to an apparatus for cleaning and ironing a fabric.

BACKGROUND

One of the most common problems associated with a fabric is that, they are most susceptible to unwanted stains. Various types of stains that are generally found on the fabric include marks of food spillovers, gum stains, mud stain, blood stain, paints, oil and grease stains etc. In order to successfully remove a stain from the fabric, a number of factors such as nature of the stain and the type of the fabric must be considered. Often, a stain mark remains persistent on the fabric, even after the fabric is washed, and would become noticeable at a later stage, say, while ironing the fabric.

However, noticing a stain in the fabric, while ironing the fabric may cause a lot of discomfort to a person who is ironing the fabric, since it would not be ideal to wash the fabric at that point of time. Hence, an apparatus that can be used for both cleaning and ironing of a fabric may be very much effective in the above scenario. Further, if the stains on the fabric are not managed properly and timely, the stains may become persistent and damage the fabric.

The issue mainly faced in the apparatus for cleaning the fabric includes detecting the type of fabric, determining a region of stain and determining type of stain in the region of stain.

SUMMARY

The present disclosure relates to an apparatus comprising at least one image capturing unit to capture one or more images of a fabric. Further, the apparatus comprises a control unit. The control unit is configured to generate a first control signal upon detecting a region of stain in the fabric based on the one or more images of the fabric. The first control signal activates an ejecting unit in the apparatus. The control unit also detects type of stain in the region of stain based on the one or more images of the fabric. Furthermore, the apparatus comprises a cleaning unit. The cleaning unit comprises a container to store one or more cleaning agents, the ejecting unit to apply one of the one or more cleaning agents on to the region of stain based on the first control signal and a motorized wiper and a motorized sucking mechanism to remove stain from the region of stain using the one of the one or more cleaning agents. At least one of the motorized wiper and the motorized sucking mechanism are activated based on the type of stain.

Further, the present disclosure relates to a method of cleaning a fabric. The method comprises capturing one or more images of the fabric using at least one image capturing unit in an apparatus. Further, a first control signal is generated upon detecting a region of stain in the fabric based on the one or more images of the fabric. Type of stain in the region of stain is determined based on the one or more images of the fabric. After determining the type of stain, the first control signal is transmitted to an ejecting unit in the apparatus. The ejecting unit applies one of one or more cleaning agents on to the region of stain based on the first control signal. Finally, at least one of a motorized wiper and a motorized sucking mechanism are activated for removing stain from the region of stain using the one of the one or more cleaning agents based on the type of stain.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The accompanying drawings, which are incorporated in and constitute a part of this disclosure, illustrate exemplary embodiments and, together with the description, serve to explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and with reference to the accompanying figures, in which.

Figure 1:
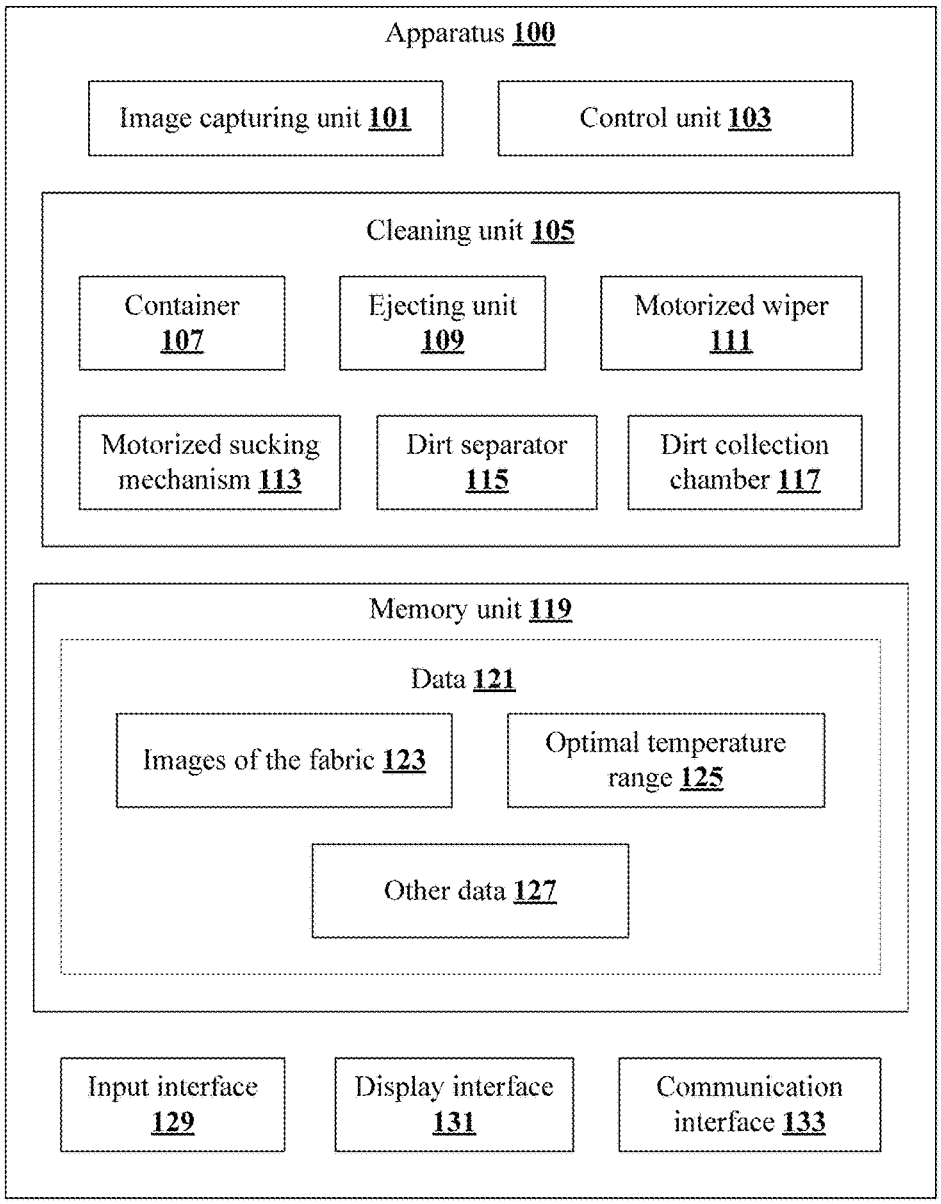
FIG. 1 shows a detailed block diagram illustrating an apparatus for cleaning a fabric in accordance with some embodiments of the present disclosure.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes which may be substantially represented in computer readable medium and executed by a computer or processor, whether or not such computer or processor is explicitly shown.

DETAILED DESCRIPTION

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the particular forms disclosed, but on the contrary, the disclosure is to cover all modifications, equivalents, and alternative falling within the spirit and the scope of the disclosure.

The terms "comprises", "comprising", or any other variations thereof, are intended to cover a non-exclusive inclusion, such that a setup, device or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or method.

The present disclosure relates to an apparatus comprising one or more image capturing units configured at one or more predefined positions. Each of the one or more image capturing unit captures one or more images of the fabric. A control unit configured in the apparatus detects a region of stain in the fabric based on the one or more images of the fabric. Further, the control unit generates a first control signal upon detecting the region of stain in the fabric. The first control signal is transmitted to a cleaning unit in the apparatus for activating an ejecting unit in the cleaning unit. The ejecting unit applies one or more cleaning agents on to the region of stain, upon being activated by the first control signal, in order to clean the region of stain with one of the one or more cleaning agents. As an example, the one or more cleaning agents may include, without limiting to, soaps, detergents, cleaning solutions and/or one or more stain removers. The one or more cleaning agents may be stored in a container within the cleaning unit. In an embodiment, the container may comprise one or more compartments to store the one or cleaning agents separately, thereby avoiding mixing up of the one or more cleaning agents inside the apparatus.

In an embodiment, one of the one or more cleaning agents to be applied on to the region of fabric is selected based on type of the fabric and type of the stain in the region of stain. After the ejecting unit applies one of the one or more cleaning agents on to the region of stain, a motorized wiper in the cleaning unit gets activated and removes stain from the region of stain. Alternatively, a motorized sucking mechanism in the cleaning unit may be used to clean and/or remove the stain from the region of stain. In an embodiment, either the motorized wiper or the motorized mechanism is activated based on the type of stain in the region of stain. As an example, the motorized sucking mechanism may be activated when the stain comprises one or more solid material such as, mud particles and food items that can be sucked off from the region of stain. On the other hand, the motorized wiping mechanism may be activated when the region of stain comprises one or more non-solid and/or semi-liquid material such as paints and beverages that can be wiped or brushed off from the region of stain. Further, the cleaning unit may comprise a dirt separator to separate one or more particles of dirt stuck on the motorized wiper and the motorized sucking mechanism. The one or more particles of dirt may be stuck on the surface of the motorized wiper or the motorized sucking mechanism while cleaning the stain. The one or more particles of dirt separated by the dirt separator may be collected and stored in a dirt collection chamber in the cleaning unit, which may be emptied when becomes full.

In an embodiment, the control unit of the apparatus may be further configured to detect the type of the fabric based on the one or more images of the fabric captured by the one or more image capturing units. Further, the control unit generates a second control signal to activate a heating element in the apparatus when the first control signal is absent and/or when the control unit receives an explicit instruction from user. Upon activation, the heating element facilitates ironing of the fabric in an optimal range of temperature. In an embodiment, the control unit determines the optimal range of temperature for ironing the fabric based on the type of the fabric. As an example, the optimal range of temperature for ironing a cotton type fabric may be 180° C. to 200° C. In an implementation, the control unit further comprises notifying the user of the apparatus when the temperature of the heating element is within the optimal range of temperature and the apparatus is ready for ironing, thereby providing additional flexibility and convenience to the user. In an embodiment, the cleaning unit may be retracted inside the apparatus during ironing of the fabric, in order to enable smooth ironing of the fabric.

The apparatus explained hereinabove provides a means for both cleaning and ironing of the fabric, thereby enhancing convenience in cleaning of the fabric.

In the following detailed description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

FIG. 1 shows a detailed block diagram illustrating an apparatus for cleaning a fabric in accordance with some embodiments of the present disclosure.

Figure 2A:
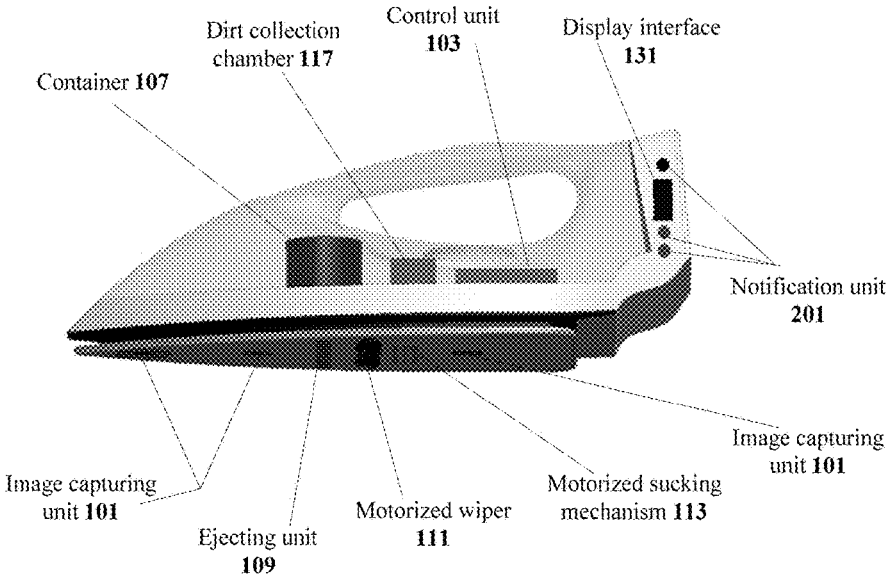
FIG. 2A shows a side view of the apparatus in accordance with some embodiments of the present disclosure.

In an implementation, the apparatus 100 comprises at least one image capturing unit 101, a control unit 103, a cleaning unit 105, a memory unit 119, an input interface 129, a display interface 131 and a communication interface 133. The cleaning unit 105 further comprises a container 107, an ejecting unit 109, a motorized wiper 111, a motorized sucking mechanism 113, a dirt separator 115 and a dirt collection chamber 117. FIG. 2A illustrates an exemplary arrangement of the components in the apparatus 100. However, the apparatus 100 shall have all general features of a fabric iron and shall have all the capabilities that are necessary for ironing of a fabric. Additionally, the apparatus 100 may accommodate all the components described in the disclosure, for cleaning and ironing of the fabric.

Figure 2B:
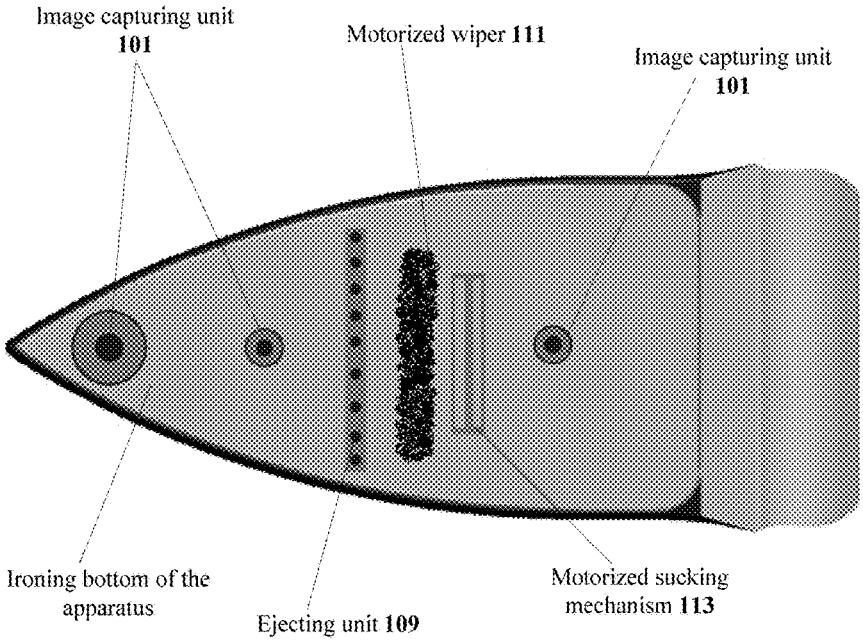
FIG. 2B shows a bottom view of the apparatus in accordance with some embodiments of the present disclosure.

In an embodiment, the at least one image capturing unit 101 may be used for capturing one or more images of the fabric 123. The at least one image capturing unit 101 may also be used to capture one or more images of the region of stain in the fabric. The at least one image capturing unit 101 may be placed and/or configured in one or more predetermined positions of the apparatus 100. As an example, the at least one image capturing unit 101 may be placed at the tip of the apparatus 100 for capturing the one or more images of the fabric 123 or images of the region of stain in the fabric along the path of movement of the apparatus 100. In another example, a plurality of the image capturing units 101 may be placed at the bottom face of the apparatus 100, such that, each of the plurality of the image capturing unit 101 are capable of capturing images of entire fabric under the apparatus 100. An exemplary representation of various positions of the at least one image capturing units 101 is shown in FIG. 2B.

In another embodiment, the at least one image capturing unit 101 may be an image sensor that captures the traces of the stain based on the variations in texture, color pattern and color intensity across different regions in the fabric. In yet another embodiment, the at least one image capturing unit 101 may be a depth-sensing camera that may be used to identify if the stain is projecting on the surface of the fabric based on the variations.

In an implementation, each of the at least one image capturing unit 101 may be placed inside a thermally insulating pocket made of a thermally non-conductive material such as, fiberglass or polystyrene, to safeguard each of the at least one image capturing unit 101 from over-heating. Further, a portion of the thermally insulating pocket may be made of a transparent material, such that, the view of the fabric is not obstructed while capturing the one or more images of the fabric 123.

In another embodiment, the at least one image capturing unit 101 may be detachable from the apparatus 100 for timely replacements, services and/or cleaning of the at least one image capturing unit 101.

In an embodiment, the control unit 103 is a central processing unit ("CPU" or "processor") in the apparatus 100. The control unit 103 may include specialized processing units such as integrated system (bus) controllers, memory management control units, floating point units, graphics processing units, digital signal processing units, etc. Further, the control unit 103 may be disposed in communication with the memory unit 119 for accessing various data stored in the memory while performing various functions of the apparatus 100.

In an embodiment, the control unit 103 may be configured to generate a first control signal upon detecting the region of stain in the fabric based on the one or more images of the fabric 123. The region of stain in the fabric may be identified by performing one or more image processing techniques on the one or more images of the fabric 123 to determine regions that have one or more variations in the texture, color pattern and intensity. The control unit 103 also determines the type of the stain in the region of the stain based on the one or more images of the fabric 123. As an example, various types of the stain may include, without limiting to, general dirt, organic stains (coffee, tea etc.), oil-based (grease, tar etc.), biological (alga, moss etc.), metallic (rust, copper stain), ink stains (markers, pen ink etc.) and paints. In an embodiment, the first control signal generated by the control unit 103 activates the ejecting unit 109 in the cleaning unit 105 for initializing the cleaning of the region of stain in the fabric.

In an embodiment, the control unit 103 may cause the at least one image capturing units 101 to capture the one or more images of the region of stain in the fabric, each time the region of stain is cleaned by the cleaning unit 105. Later, the control unit 103 may compare each of the one or more images of the region of stain in the fabric, subsequent to each round of cleaning, in order to determine whether the stain has been removed completely from the region of stain. The above sequence of process may be continued until the stain is completely removed from the region of stain in the fabric.

In an embodiment, the control unit 103 may be further configured to detect the type of the fabric based on the one or more images of the fabric 123. Upon detecting the type of the fabric, the control unit 103 generates a second control signal in absence of the first control signal or upon receiving an input from the user to stop the cleaning process and to start with the ironing process. The second control signal activates a heating element in the apparatus 100. The heating element facilitates the ironing of the fabric. In other words, the ironing of the fabric takes place only when the cleaning process of the fabric is suspended. Further, the second control signal may include an optimal temperature range 125, which is the ideal temperature to be achieved by the heating element while ironing of the fabric. The control unit 103 determines the optimal temperature range 125 based on the type of the fabric. Sample range of optimal temperatures for various types of fabric is indicated in the further section of the disclosure i.e. in TABLE A.

In an embodiment, the cleaning unit 105 facilitates the cleaning of the fabric using one or more components in the cleaning unit 105. The container 107 in the cleaning unit 105 stores one or more cleaning agents to be used for cleaning the fabric. In an implementation the cleaning unit 105 may comprise a plurality of compartments to store the one or more cleaning agents separately, thereby preventing the mixing of the one or more cleaning agents in the container 107. In one embodiment, each of the compartments in the container 107 may be made of a spill-proof material to prevent spilling and/or mixing of the one or more cleaning agents within the container 107. In another embodiment, the compartments holding the cleaning fluids can be designed as cartridges, for easy changing and replacement. As an example, the one or more cleaning agents stored in the container 107 may include, without limiting to, soaps, detergents, cleaning solutions and/or one or more stain removers. Further, the one or more cleaning agents may be any solution/material that is suitable for cleaning the particular fabric being cleaned and/or ironed, ranging from normal washing soap to any dry cleaning chemical solvent.

In one implementation, one of the pluralities of compartments in the container 107 may be used to store clean water. The clean water may be used to completely remove traces of stain and/or excess amount of the one or more cleaning agents used for cleaning the region of stain.

In an embodiment, the ejecting unit 109 may be used for applying a selected one of the one or more cleaning agents on to the region of stain for cleaning and removing the stain from the region of stain. The one of the one or more cleaning agents to be used for cleaning the region of stain may be selected based on the type of the fabric and the type of the stain. For example, when washing a synthetic fabric, regular detergents that contain enzymes may be used instead of harsh chemicals like bleach since the synthetic fabrics are known to react fast for organic bleaches. Similarly, a few drops of white vinegar may be applied on a vegetable stain (E.g.: due to Tomato juice) since the white vinegar is known to dilute the vegetable stains.

In an implementation, one end of the ejecting device may be made of a nozzle-like opening at the bottom face of the apparatus 100 (as shown in FIG. 2B), thereby facilitating the ejecting device to apply the selected one of the one or more cleaning agents exactly on to the region of stain in the fabric. Further, other end of the ejecting device may be attached to the container 107, such that the ejecting device may come in contact with one of the one or more compartments in the container 107, thereby accessing the one or more cleaning agents. Finally, the ejecting unit 109 may apply a specific quantity of the clean water to complete the cleaning of the fabric.

In an embodiment, the motorized wiper 111 in the cleaning unit 105 may be used to wipe off the one or more particles of dirt from the region of the stain after the one or more cleaning agents are applied on the region of stain. As an example, the motorized wiper 111 may be a rolling wiper mechanism that rolls over the region of stain in the fabric and collects the one or more particles of dirt/stain that come in touch with the surface of the rolling wiper. In an implementation, the motorized wiper 111 may be made detachable from the cleaning unit 105 for washing and/or replacing the motorized wiper 111 when required.

In an embodiment, the motorized sucking mechanism 113 in the cleaning unit 105 may be used to collect the one or more particles of dirt from the region of stain. In one implementation, the motorized sucking mechanism 113 may be similar to that of an air pump based cleaning devices that are used to suck dust and dirt from the surface of the stain.

In an embodiment, the dirt separator 115 in the cleaning unit 105 may be used to separate the one or more particles of dirt collected by the motorized wiper 111 and the motorized sucking mechanism 113. Separation of the one or more particles of dirt from the motorized wiper 111 and the motorized sucking mechanism 113 prevents the already collected dirt particles from gluing back on to the cleaned surface of the fabric. In one implementation, the dirt separator 115 may be placed in conjunction with the dirt collection chamber 117 in the cleaning unit 105.

The dirt collection chamber 117 may be used to collect and store the one or more particles of dirt that are separated by the dirt separator 115. The dirt collection chamber 117 may be made detachable from the cleaning unit 105 in order to enable the user of the apparatus 100 to empty all the dirt particles collected and stored in the dirt collection chamber 117.

In an embodiment, the cleaning unit 105 may be retracted inside the apparatus 100 when the apparatus 100 is being used for ironing of the fabric (or in absence of the first control signal). Retracting the cleaning unit 105 inside the apparatus 100 ensures that the one or more components in the cleaning unit 105 i.e., the container 107, the ejecting unit 109, the motorized wiper 111, the motorized sucking mechanism 113, the dirt separator 115 and the dirt collection chamber 117 do not obstruct the bottom face of the apparatus 100 for smooth ironing of the fabric.

In an embodiment, each component of the cleaning unit 105 may be placed in a thermally insulating pocket to safeguard the components (E.g. the motorized wiper 111 and the motorized sucking mechanism 113) from excessive heat generated by the heating element in the apparatus 100. Further, placing the container 107 in the thermally insulating pocket may be essential to preserve the original state and properties of the one or more cleaning agents.

In an embodiment, the memory unit 119 may store one or more data 121. The memory unit 119 may include, without limitation, memory drives, removable disc drives, etc. The memory unit 119 may also store a collection of program or database components, including, without limitation, a User Interface (UI) application and an operating system. The other data 127 in the memory unit 119 may store data, including temporary data and temporary files, generated by the control unit 103.

In an embodiment, the one or more images of the fabric 123 are captured by the at least one image capturing unit 101 in the apparatus 100. The one or more images of the fabric 123 may be used to determine the type of the fabric and to detect the region of stain in the fabric. In one implementation, the at least one image capturing units 101 may capture the one or more images of the fabric 123 at one or more regular time intervals, for example at every 3 seconds. In another implementation, the one or more images of the fabric 123 may be captured upon detecting the movement of the apparatus 100 and when the apparatus 100 comes in contact with the fabric. In yet another implementation, the one or more images of the fabric 123 may be captured upon receiving input from the user through the input interface 129.

In an embodiment the optimal temperature range 125 is the most ideal temperature to be used while ironing a particular type of fabric. In other words, the optimal temperature range 125 corresponding to a fabric is the maximum temperature that the fabric can withstand without damage. The control unit 103 determines the optimal temperature range 125 based on the type of the fabric. In an embodiment, the control unit 103 may determine the optimal temperature range 125 based on a predetermined optimal temperature table that indicates the most optimal temperature range 125 corresponding to a particular type of the fabric. Table A below shows an exemplary instance of the predetermined optimal range table that may be used to determine the optimal temperature range 125 for the fabric.

TABLE A

| Type of the fabric | Optimal temperature range (in degree Celsius) |
|---|---|
| Linen | 180-210 |
| Denim | 175-195 |
| Cotton | 180-200 |
| Polyester | 150-180 |
| Rayon | 145-180 |
| Silk | 130-160 |
| Wool | 120-140 |
| Acetate | 120-135 |
| Acrylic | 110-120 |
| Nylon | Less than 100 |
| Spandex | Less than 100 |

In an embodiment the heating element in apparatus 100 may suspend the heating process when the temperature of the heating element has reached the optimal temperature range 125 corresponding to the type of the fabric being cleaned and/or ironed. As an example, referring to TABLE A, while ironing a woolen fabric, the control unit 103 may cause the heating element to stop further heating when the temperature of the heating element has reached a temperature range of 120° C. and 140° C., since the optimal temperature range 125 for a woolen material is between 120° C. and 140°. Hence, the automated heat cut-off mechanism disclosed hereinabove ensures that the fabric being ironed is never over-heated and/or burnt while ironing.

In an embodiment, the input interface 129 may be used for receiving one or more inputs from the user. As an example, the one or more inputs received from the user may include, without limiting to, initiate generation of the second control signal (thereby activating the heating element), a user-defined optimal temperature range 125 and one or more details related to one or more devices associated with the user. As an example, while ironing a cotton fabric, the user may specifically set the temperature range as 140° C., as per the user's wish, using the input interface 129. In one implementation, the input interface 129 may be in the form of a keypad such as an alphanumeric keypad, using which the user may key-in the one or more inputs to the apparatus 100, as shown in FIG. 2C.

In one scenario, the input interface 129 may comprise a button, for example, a 'pass' key, that, when depressed by the user causes the apparatus 100 to avoid the cleaning of the fabric even when the region of stain is detected in the fabric. As an example, the user may depress the 'pass' key to avoid cleaning when the user wishes to retain and/or ignore a particular stain in the fabric or when the user is in a hurry and wants to continue only with the ironing of the fabric. Thus, the 'pass' key provides an additional flexibility to the user.

In an embodiment, the display interface 131 may be used to display information related to the fabric and the apparatus 100. As an example, the information that may be displayed on the display interface 131 includes, without limiting to, one or more images of the fabric 123, image of the region of stain in the fabric, name of the type of the fabric, the optimal temperature range 125 being set for the fabric being ironed and status information of the cleaning unit 105. For example the status information of the cleaning unit 105 may include information such as, amount of the one or more cleaning agents remaining in the container 107, notification to replacement and/or cleaning of the motorized wiper 111 and the motorized sucking mechanism 113 and notification to dispose the dirt stored in the dirt collection chamber 117 when the dirt collection chamber 117 is full.

Figure 2C:
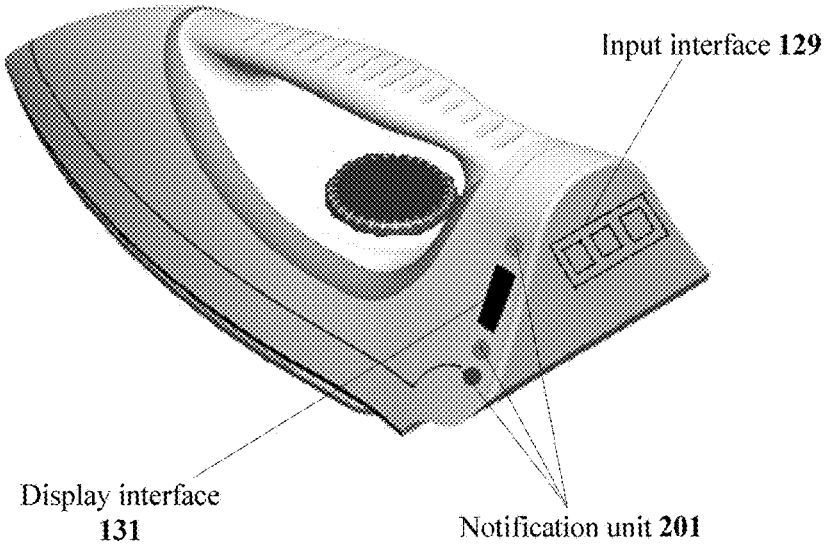
FIG. 2C shows a perspective view of the apparatus in accordance with some embodiments of the present disclosure.

In an implementation, a part of the display interface 131 may be configured to house a notification unit 201 comprising one or more Light Emitting Diodes (LEDs) as shown in FIG. 2C. The notification unit 201 may be used to notify the user when one or more predefined events occur, by illuminating one of the one or more LEDs in the notification unit 201. As an example, one of the one or more predefined events may be that, the temperature of the heating element has reached the optimal temperature range 125 and the apparatus 100 is ready for heating. In the above scenario, the notification unit 201 may illuminate a 'Green' LED to notify the user that the apparatus 100 is ready for ironing. Similarly, the notification unit 201 may toggle between two LEDs, say a 'Red' LED and a 'Blue' LED, to indicate whether the apparatus 100 is activated for cleaning or the apparatus 100 is activated for ironing respectively.

In another embodiment, each of the information related to the fabric and the apparatus 100, along with the various notifications may be communicated to one or more user devices associated with the user through the communication interface 133 configured in the apparatus 100. In an implementation, the communication interface 133 may use any wired (such as LAN, Ethernet etc.) and/or wireless (Wi-Fi, Bluetooth etc.) communication medium for communicating with the one or more user devices.

Exemplary Scenario:

Consider a user who wants to clean and/or iron his jeans trouser using the apparatus 100. The user may place the jeans trouser on a pressing table and start moving the apparatus 100 on the trouser for cleaning and/or ironing the trouser. As the apparatus 100 starts moving, one of the at least one image capturing unit 101 placed on the bottom face of the apparatus 100 captures one or more images 123 of the trouser. Now, the control unit 103 in the apparatus 100 analyzes the one or more images 123 to identify a region of stain in the trouser, if any. If a region of stain is identified, the control unit 103 transmits the one or more images 123 to the display interface 131 to indicate/display the region of stain to the user. On seeing the region of stain being displayed on the display interface 131, the user may either wish to clean the region of stain in the trouser or may skip the cleaning and proceed with only the ironing of the trouser.

If the user wishes to clean the region of stain, then the user may hold the apparatus 100 on the region of stain for a predetermined time period, for example 2 seconds, or provide an input based on which the control unit 103 generates the first control signal. The first control signal generated by the control unit 103 activates the ejecting unit 109 in the cleaning unit 105 of the apparatus 100 and initiates the cleaning process. Upon activation, the ejecting unit 105 and the entire cleaning unit 105 are projected out of the apparatus 100 for facilitating the cleaning of the region of stain in the trouser. Now, the ejecting unit 109 applies a cleaning agent stored in the container 107 on to the region of stain in the trouser for removing the stain from the trouser. Here, the cleaning agent applied on the trouser may be a detergent powder that is suitable for cleaning the jeans trouser. Further, the motorized wiper 111 and/or the motorized sucking mechanism 113 in the cleaning unit 105 operate on the region of stain and remove the stain/one or more particles of dirt from the region of stain. The stain/one or more particles of dirt stuck on the motorized wiper 111 and/or the motorized sucking mechanism 113 are separated and stored by the dirt separator 115 and the dirt collection chamber 117 respectively. Furthermore, a sufficient amount of clean water may be applied on the region of stain to eliminate traces of stain and/or cleaning agents remaining on the region of stain. Thereafter, the control unit 103 compares one or more fresh images of the trouser with the one or more previously captured images 123 of the region of stain to check whether the stain has been completely removed from the region of stain. If there is any stain remaining in the region of stain, the control unit 103 re-initiates the entire cleaning process, thereby cleaning the trouser completely. Finally, after the cleaning process is complete, the entire cleaning unit 105 is retracted inside the apparatus 100, such that the cleaning unit 105 will not obstruct ironing of the trouser.

On the other hand, if the user chooses to avoid the cleaning of the trouser and continue only with the ironing, the control unit 103 generates a second control signal, activating the heating element in the apparatus 100 for heating. Now, once the heating element is heated to the optimal temperature range of the jeans material, i.e. 120° C. to 140° C., the control unit 103 notifies the user that the apparatus 100 is ready for ironing. The user may be notified by illuminating a LED in the notification unit 201 and/or by transmitting a suitable message to the one or more user devices. Upon receiving the notification, the user may start ironing the trouser.

In an example, the user may perform both ironing and cleaning of the trouser using the apparatus 100. In that case, the ironing of the trouser may be performed subsequent to completion of the cleaning of the trouser. Similarly, the user may perform only the cleaning or ironing of the trouser based on the requirement.

Figure 3:
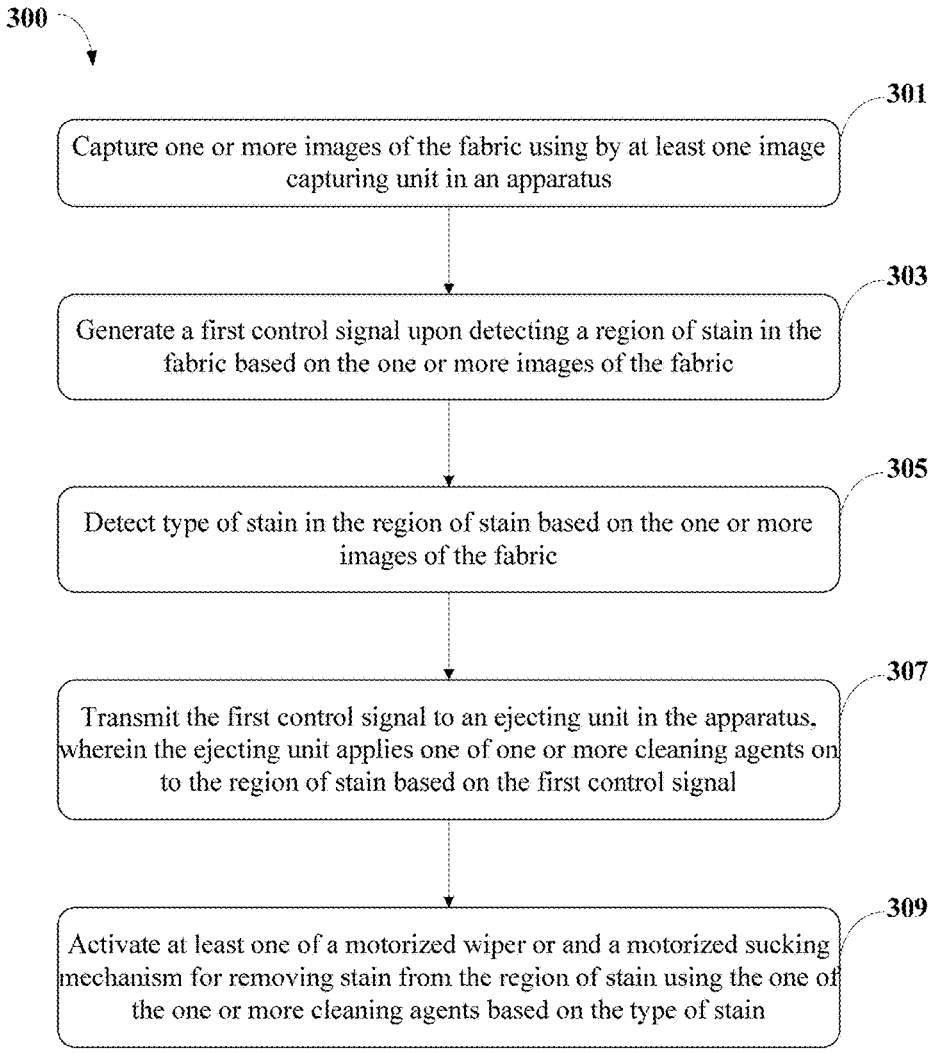
FIG. 3 illustrates a flowchart showing a method of cleaning the fabric using the apparatus in accordance with some embodiments of the present disclosure.

FIG. 3 illustrates a flowchart showing a method cleaning the fabric using the apparatus in accordance with some embodiments of the present disclosure.

As illustrated in FIG. 3, the method 300 comprises one or more blocks describing steps in cleaning of the fabric using the apparatus 100. The method 300 may be described in the general context of computer executable instructions. Generally, computer executable instructions can include routines, programs, objects, components, data structures, procedures, modules, and functions, which perform particular functions or implement particular abstract data types.

The order in which the method 300 is described is not intended to be construed as a limitation, and any number of the described method blocks can be combined in any order to implement the method. Additionally, individual blocks may be deleted from the methods without departing from the spirit and scope of the subject matter described herein. Furthermore, the method can be implemented in any suitable hardware, software, firmware, or combination thereof.

At block 301, at least one image capturing unit 101 in the apparatus 100 captures one or more images of the fabric 123. In an embodiment, the one or more images of the fabric 123, captured by the at least one image capturing unit 101 may be used to detect type of the fabric and to determine a region of stain in the fabric.

At block 303, the control unit 103 generates a first control signal upon detecting the region of stain in the fabric based on the one or more images of the fabric 123. In an embodiment, the region of stain in the fabric may be identified by determining one or more variations in the pattern of the fabric and variation in color intensity and color pattern of the fabric. The first control signal may be transmitted to an ejecting unit 109 in the apparatus 100, to activate the ejecting unit 109 for cleaning of the fabric.

At block 305, the control unit 103 detects type of stain in the region of stain based on the one or more images of the fabric 123. As an example, various types of the stain may include, without limiting to, general dirt (out of age), organic stains (coffee, tea etc.), oil-based (grease, tar etc.), biological (alga, moss etc.), metallic (rust, copper stain), ink stains (markers, pen ink etc.) and paints.

At block 307, the control unit 103 transmits the first control signal to an ejecting unit 109 in the apparatus 100. The ejecting unit 109 applies one of one or more cleaning agents on to the region of stain based on the first control signal. In an embodiment, each of the one or more cleaning agents is stored separately within a plurality of compartments in the container 107. The one or more cleaning agents to be used for cleaning the region of stain in the fabric may be selected based on the type of the fabric being cleaned and the type of the stain.

At block 309, the control unit 103 activates at least one of a motorized wiper 111 and a motorized sucking mechanism 113 for removing stain from the region of stain using the one of the one or more cleaning agents based on the type of stain. In an embodiment, one or more particles of dirt stuck on at least one of the motorized wiper 111 and the motorized sucking mechanism 113 may be separated using a dirt separator 115 in the apparatus 100. Further, the one or more particles of the dirt separated by the dirt separator 115 may be collected and stored in a dirt collection chamber 117 of the apparatus 100.

In an embodiment, the control unit 103 in the apparatus 100 may be further configured to detect the type of the fabric based on the one or more images of the fabric 123. Further, the control unit 103 may generate a second control signal in absence of the first control signal or upon receipt of an input from a user. The second control signal, when transmitted to a heating element in the apparatus 100, activates the heating element, wherein the heating element facilitates ironing of the fabric based on the second control signal. In an embodiment, the second control signal may include an optimal temperature range 125 for ironing the fabric based on the type of the fabric. The optimal temperature range 125 may be an ideal temperature that may be used for ironing of the fabric. In one implementation, the cleaning unit 105 may be retracted inside the apparatus 100 during ironing of the fabric.

In an embodiment, the present disclosure provides a method and an apparatus that facilitates both cleaning and ironing of a fabric.

In an embodiment, the method and apparatus of the present disclosure enables a user to remove stain from the exact region of stain in the fabric, without the need to wash the entire fabric.

In an embodiment, the method and apparatus of the present disclosure prevents over-heating and/or burning of the fabric by ironing the fabric in an optimal range of temperature, which is ideal for the fabric being ironed.

In an embodiment, the method and apparatus of the present disclosure provides a means of hand-held cleaning of the fabric, thereby providing additional flexibility to the users.

The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise.

The terms "including", "comprising", "having" and variations thereof mean "including but not limited to", unless expressly specified otherwise.

The terms "a", "an" and "the" mean "one or more", unless expressly specified otherwise.

A description of an embodiment with several components in communication with each other does not imply that all such components are required. On the contrary a variety of optional components are described to illustrate the wide variety of possible embodiments of the invention.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article or a different number of devices/articles may be used instead of the shown number of devices or programs. The functionality and/or the features of a device may be alternatively embodied by one or more other devices which are not explicitly described as having such functionality/features. Thus, other embodiments of the invention need not include the device itself.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the embodiments of the present invention are intended to be illustrative, but not limiting, of the scope of the invention, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus for cleaning a fabric, the apparatus comprising one or more processors configured to execute one or more instructions that cause the apparatus to:

capture one or more images of a fabric based on one or more image sensors;

apply one of one or more cleaning agents on to a region of a stain based on a first control signal;

remove the stain from the region of the stain using the one of the one or more cleaning agents, wherein the removal is based on motorized wiping and motorized sucking performed on the stain, wherein the motorized wiping and motorized sucking is activated based on a type of the stain; and generate the first control signal upon detecting the region of the stain in the fabric based on the captured one or more images of the fabric, wherein the first control signal enables application of the one of the one or more cleaning agents on to the region of the stain; and detect the type of the stain in the region of the stain based on the captured one or more images of the fabric.

2. The apparatus as set forth in claim 1 wherein the one or more processors are configured to execute the one or more instructions that further cause the apparatus to:

detect a fabric type based on the captured one or more images of the fabric;

generate a second control signal in absence of the generated first control signal or upon receipt of an input; and transmit the generated second control signal to a heating element to initiate ironing of the fabric based on the second control signal.

3. The apparatus as claimed in claim 2, wherein the second control signal includes an optimal temperature range for ironing the fabric based on the type of the fabric.

4. The apparatus as claimed in claim 2 further comprises an input interface to receive one or more inputs.

5. The apparatus as set forth in claim 1 wherein the one or more processors are configured to execute the one or more instructions that further cause the apparatus to display information related to the fabric.

6. The apparatus as claimed in claim 5 further comprises a communication interface configured to communicate data related to the fabric to one or more user devices.

7. The apparatus as claimed in claim 1 wherein the apparatus further comprises a plurality of compartments for storing each of the one or more cleaning agents separately.

8. The apparatus as claimed in claim 1, wherein the applied cleaning agent is selected based on the fabric type and the type of the stain.

9. The apparatus as claimed in claim 1, wherein the one or more processors are configured to execute the one or more instructions that further cause the apparatus to separate dirt particles stuck on the apparatus as a consequence of performing at least one of the motorized wiping or the motorized sucking.

10. The apparatus as claimed in claim 9, wherein the one or more processors are configured to execute the one or more instructions that further cause the apparatus to collect and store the separated dirt particles.

* * * * *